US005986525A

United States Patent [19]

Sasaki et al.

[11] Patent Number: 5,986,525

[45] Date of Patent: Nov. 16, 1999

[54] FILTER DEVICE HAVING A DISTRIBUTED-CONSTANT-LINE-TYPE RESONATOR

[75] Inventors: Yutaka Sasaki, Nagaokakyo; Hiroaki Tanaka, Mishima-gun, both of Japan

[73] Assignee: Murata Manufacturing Co., Ltd., Japan

[21] Appl. No.: 08/966,991

[22] Filed: Nov. 10, 1997

[30] Foreign Application Priority Data

Nov. 8, 1996 [JP] Japan ..... 8-296365

[51] Int. Cl.[6] ..... H01P 1/203

[52] U.S. Cl. ..... 333/203; 333/204

[58] Field of Search ..... 333/203–205, 333/219

[56] References Cited

U.S. PATENT DOCUMENTS

| | | | |
|---|---|---|---|
| 3,451,015 | 6/1969 | Heath | 333/203 |
| 4,488,130 | 12/1984 | Young et al. | 333/203 |
| 4,721,931 | 1/1988 | Nishikawa et al. | 333/204 X |
| 5,055,809 | 10/1991 | Sagawa et al. | 333/219 |
| 5,248,949 | 9/1993 | Eguchi et al. | 333/204 |
| 5,506,553 | 4/1996 | Makita et al. | 333/204 |
| 5,621,366 | 4/1997 | Gu et al. | 333/204 |
| 5,770,986 | 6/1998 | Tonegawa et al. | 333/204 |

FOREIGN PATENT DOCUMENTS

| | | | |
|---|---|---|---|
| 0429067 | 5/1991 | European Pat. Off. . | |
| 0688058 | 12/1995 | European Pat. Off. . | |
| 2-206201 | 8/1990 | Japan | 333/204 |
| 1083257 | 3/1984 | U.S.S.R. | 333/204 |

OTHER PUBLICATIONS

Patent Abstracts of Japan, vol. 7, No. 166 (E–188), Jul. 21, 1983 & JP 58 071701 A (Maspro Denko KK), Apr. 28, 1983, abstract.

Patent Abstracts of Japan, vol. 96, No. 10, Oct. 31, 1996 & JP 08 167801 A (Murata Mfg Co Ltd), Jun. 25, 1996, abstract.

Patent Abstracts of Japan, vol. 96, No. 11, Nov. 29, 1996 & JP 08 191201 A (Murata Mfg Co Ltd), Jul. 23, 1996, abstract.

European Search Report dated Feb. 19, 1998.

*Primary Examiner*—Seungsook Ham

*Attorney, Agent, or Firm*—Ostrolenk, Faber, Gerb & Soffen, LLP

[57] ABSTRACT

A line width on the grounded side of distributed-constant-line-type resonators which form a distributed-constant-line-type filter is made wider than a line width on the open side. By increasing the line width on the grounded side, where a larger electric current flows, of a distributed-constant-line-type resonator, the line resistance of the distributed-constant line decreases, making it possible to reduce the loss of the distributed-constant-line-type resonator and further to reduce the insertion loss of the distributed-constant-line-type filter. Further, by decreasing the line width on the open side to less than the line width on the grounded side, an increase in the size of the filter because the line width on the grounded side is increased can be prevented.

14 Claims, 6 Drawing Sheets

FILTER DEVICE HAVING A DISTRIBUTED-CONSTANT-LINE-TYPE RESONATOR

BACKGROUND OF THE INVENTION

1. Field of the Invention

The present invention relates to a filter device and, more particularly, to a distributed-constant-line-type filter.

2. Description of the Related Art

Since distributed-constant-line-type filters are typically formed of a strip line, they are thinner and lighter than filters using a block resonator, and are used for signal processing of a portable telephone set requiring a strictly smaller size.

FIG. 9 shows an example of a distributed-constant-line-type filter formed by combining conventional distributed-constant-line-type resonators. A distributed-constant-line-type filter 100 is a comb-line-type filter, namely, a comb-type filter formed of a plurality of distributed-constant-line-type resonators 101, 102, 103, 104 and 105, and a grounding electrode 106 connected to the resonators. The resonators are disposed at such positions as to be coupled to each other. One end of each of the distributed-constant-line-type resonators 101 to 105 is an open end. A distributed-constant line 107 for input is connected to the outermost resonator 101. A distributed-constant line 108 for output is connected to another outermost resonator 105. The distributed-constant-line-type resonators 101 to 105, the grounding electrode 106, the input/output distributed-constant lines 107 and 108 are strip lines or may be microstrip lines.

Since the distributed-constant-line-type resonators 101, 102, 103, 104 and 105 form a resonance circuit, components having a resonance frequency of a resonance circuit from among signal components from the input 107 are sent to the output 108, and other signals are reflected by the resonance circuit and return to the input 107. That is, the distributed-constant-line-type filter 100 operates as a band-pass filter.

As a main factor for a signal loss in the distributed-constant line, there is a loss due to resistance (line resistance). In order to reduce loss, it is common practice to widen the line width so as to lower the line resistance. However, in the conventional filter 100, if the line width of the resonator is widened, the spacing between the adjacent lines becomes narrow, and the coupling between the resonators becomes too strong, causing the characteristics of the filter to vary. In order to reduce the loss of the line and adjust the coupling between the resonators to a predetermined level, the spacing between the adjacent lines may be widened. However, the size of the filter in the right-to-left direction in the figure increases.

SUMMARY OF THE INVENTION

It is an object of the present invention to provide a small distributed-constant-line-type filter having a small amount of signal loss.

According to the present invention, in a filter device having distributed-constant-line-type resonators, since the line widths are different depending upon the section, a compact resonator is provided.

Further, the line width is wider in a section within the resonator where the current amplitude is large and narrower in a section where the current amplitude is small; therefore, it is possible to effectively reduce the conductor loss of the resonator. That is, in comparison with a method of reducing conductor loss by widening the line width in all the resonators, it is possible to effectively reduce the conductor loss while keeping the resonator compact.

Furthermore, since the distributed-constant line which forms the resonator is folded, the resonator becomes compact. Even if the section in the line where the current amplitude is large is widened, it is possible to keep the entire size of the folding compact by narrowing the line width in the section where the current amplitude, which is another line which forms the folding, is small.

The above and further objects, aspects and novel features of the invention will become more apparent from the following detailed description when read in connection with the accompanying drawings.

DESCRIPTION OF THE PREFERRED EMBODIMENTS

Figure 1:
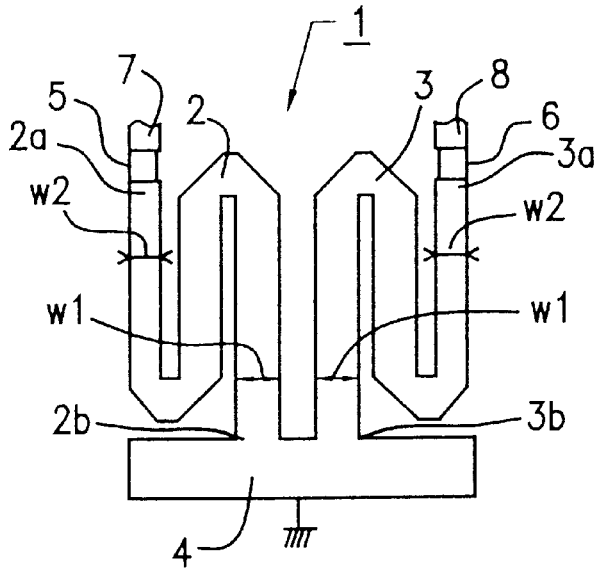
FIG. 1 shows the construction of an embodiment of a distributed-constant-line-type filter according to the present invention.
Figure 10:
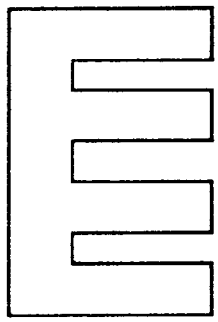
FIG. 10 shows the construction of a comb-shaped coupling capacitor.

FIG. 1 shows a distributed-constant-line-type filter 1 of the present invention. The distributed-constant-line-type filter 1 includes distributed-constant-line-type resonators 2 and 3, and a grounding electrode 4 connected to one end of each of these resonators. The length of each resonator, namely, the lengths from 2*a* to 2*b* and from 3*a* to 3*b* are approximately one fourth of the wavelength of the signal of a frequency used. That is, each of the distributed-constant-line-type resonators 2 and 3 is a $\lambda/4$-type resonator. In order to reduce the mounting area, the distributed-constant-line-type resonators 2 and 3 are formed into a folded shape. This shape is called a meandering shape. In order to reduce leakage of the propagation signal, the corners of the bent sections of the distributed-constant-line-type resonators 2 and 3 should preferably be cut. A distributed-constant line 7 for input and a distributed-constant line 8 for output are connected to the open ends of the distributed-constant-line-type resonators 2 and 3 via comb-shaped coupling capacitors 5 and 6, respectively. A comb-shaped coupling capacitor is an independent strip line having a shape such as that shown in FIG. 10, having the advantage that λ/4 within the resonator can be shortened, namely, a shorter length of the resonators 4 and 5 is required. However, when there is enough mounting space, the coupling capacitors may not be used. In the distributed-constant-line-type resonators 2 and 3, the line width w2 of near the open end is different from the line width w1 near the grounding conductor, that is, w1>w2. The resonators, the grounding conductor, and the input and output lines are formed of, for example, strip lines or microstrip lines.

The signal input from the distributed-constant line 7 for input is input to a resonance circuit formed of the distributed-constant-line-type resonators 2 and 3 via a coupling capacitor 5. The signal components having the resonance frequency of the resonance circuit from among the input signal components are output from the distributed-constant line 8 for output, and the signals of the frequency other than the resonance frequency are reflected. That is, the distributed-constant-line-type filter 1 is a band-pass filter.

Generally speaking, in the λ/4 resonator, in the distributed-constant-line-type filter, one end of which is open and the other end grounded, the amplitude of a high-frequency current which flows through the distributed-constant line is larger on the grounded-end side and decreases toward the open-end side.

In order to reduce the insertion loss of the band-pass filter, the conductor loss of the distributed-constant-line-type resonator may be decreased. In order to effectively decrease the conductor loss of the distributed-constant-line-type resonator, it is effective to enlarge the area of the strip line in a section where the amplitude of a high-frequency current is large in order to decrease the line resistance of that section.

From the point of view of decreasing the line resistance, it is ideal to increase the strip line width in all the sections of the distributed-constant-line-type filter. However, since there is a strict demand for the mounting area, the area of the strip line is increased only in the most effective section. For example, the mounting area of a band-pass filter for a portable telephone according to the present invention should be, for example, within 2 mm×2 mm.

A wider strip line of a part of the resonator increases the mounting area. In order to prevent this, the strip line width should preferably be narrow in a section where the amplitude of the high-frequency current is small within the resonator.

In the λ/4 resonator, since the amplitude of the electric current near the open ends is very small, the strip line width near the open ends is narrowed. Although a decrease in the line width increases the line resistance, the contribution to the conductor loss of all the resonators is small.

Figure 2:
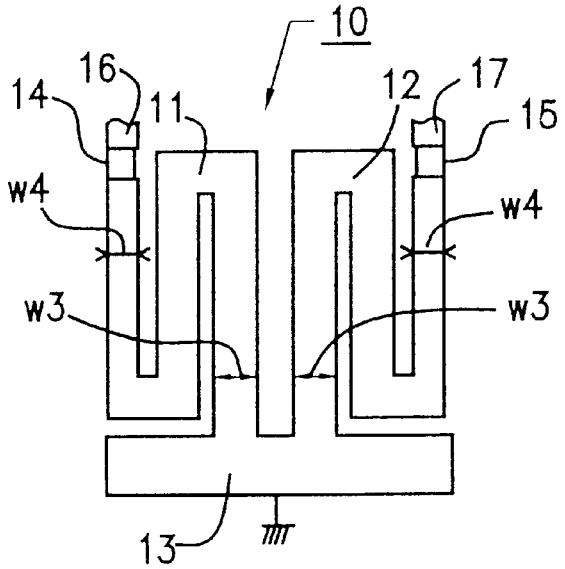
FIG. 2 shows the construction of another embodiment of a distributed-constant-line-type filter according to the present invention.

FIG. 2 shows another embodiment of a distributed-constant-line-type filter according to the present invention.

The basic construction of this embodiment is the same as that of the filter shown in FIG. 1. The differences are as described below. Since the corners of the bent sections of distributed-constant-line-type resonators 11 and 12 are not cut, the electrode area of those sections increases, and the line resistance decreases, making it possible to reduce the loss of the distributed-constant-line-type resonators and the insertion loss of the filter. As a result, the confinement characteristic of the propagation signal in the bent sections decreases slightly; however, this is an effective construction when it is desirable to reduce the insertion loss of the filter by a larger amount.

Figure 3:
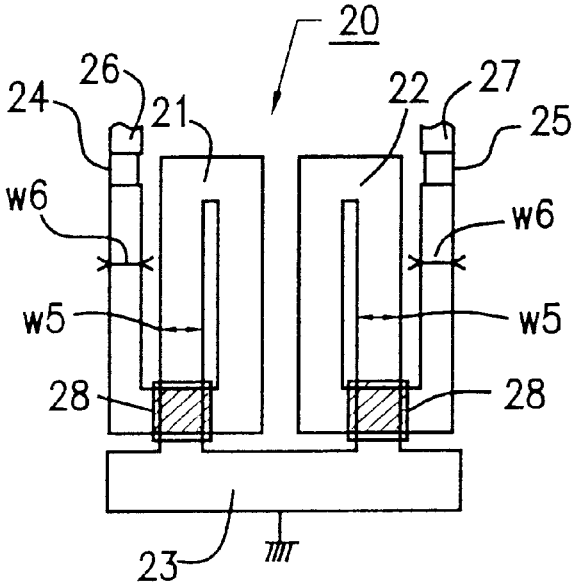
FIG. 3 shows the construction of yet another embodiment of a distributed-constant-line-type filter according to the present invention.

FIG. 3 shows yet another embodiment of a distributed-constant-line-type filter according to the present invention. A distributed-constant-line-type filter 20 includes spiral-shaped distributed-constant-line-type resonators 21 and 22. An insulating film 28 is provided at the intersection of the lines. Also in this filter, the line widths w5>w6 are set so that w5>w6.

Figure 4:
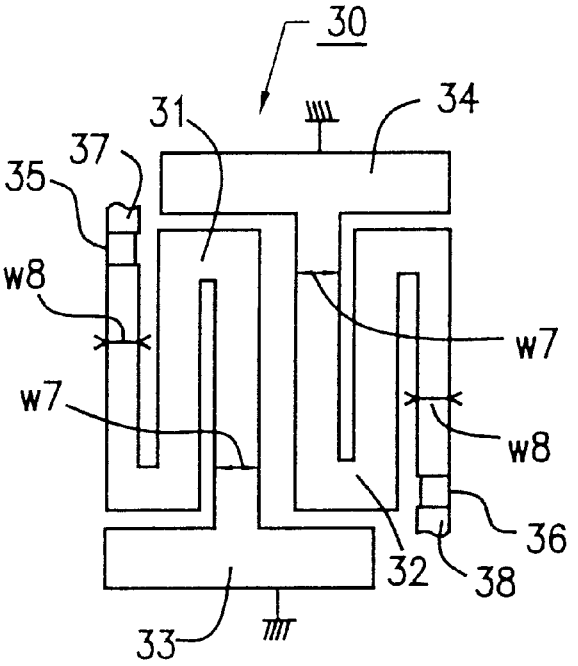
FIG. 4 shows the construction of a further embodiment of a distributed-constant-line-type filter according to the present invention.

FIG. 4 shows a further embodiment of a distributed-constant-line-type filter according to the present invention.

A distributed-constant-line-type filter 30 is an interdigital-type filter such that distributed-constant-line-type resonators 31 and 32 whose length is approximately one fourth of the wavelength of a desired frequency, one end of which is open and the other end connected to grounding electrodes 33 and 34, respectively, and grounded, are each formed in a meandering shape, and two of them are arrayed so as to be coupled to each other. A distributed-constant line 37 for input and a distributed-constant line 38 for output are connected to one end of each of the distributed-constant-line-type resonators 31 and 32 via comb-shaped coupling capacitors 35 and 36, respectively. In the distributed-constant-line-type resonators 31 and 32, the line width of one end is different from the line width of the other end. In each of them, the line width is w8 on the one end side, and the line width is w7 on the other end side, with w7 being wider than w8.

Figure 5:
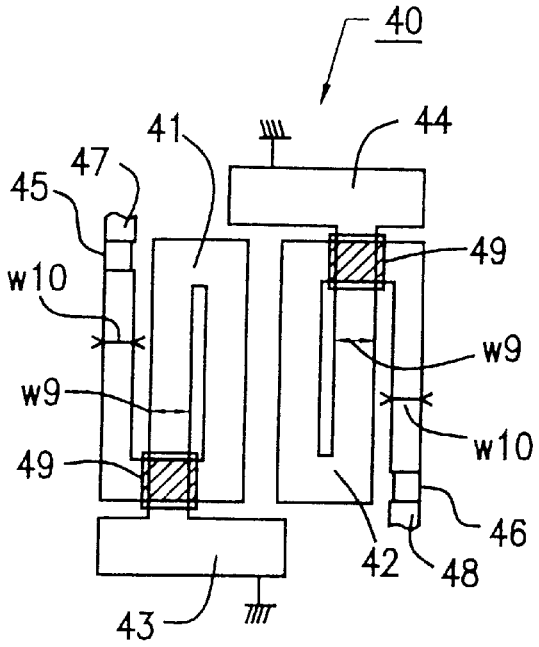
FIG. 5 shows the construction of still a further embodiment of a distributed-constant-line-type filter according to the present invention.

FIG. 5 shows still a further embodiment of a distributed-constant-line-type filter according to the present invention.

A distributed-constant-line-type filter 40 includes spiral-shaped distributed-constant-line-type resonators 41 and 42. An insulating film 49 is provided at the intersection of the lines. The line widths w9>w10 are set so that w9>w10.

Figure 6:
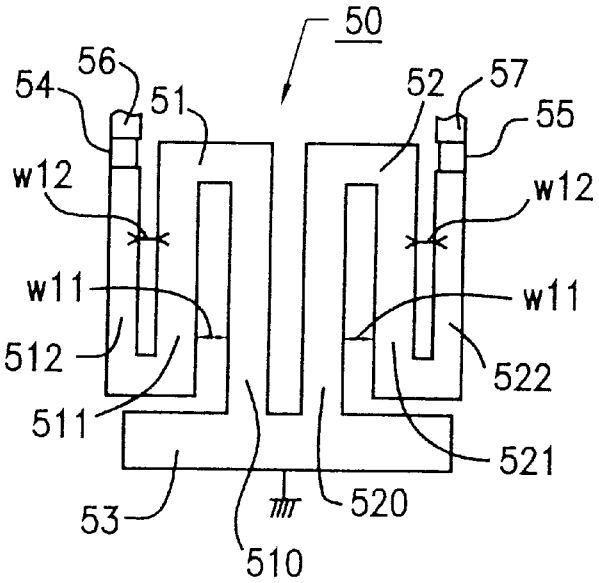
FIG. 6 shows the construction of still a further embodiment of a distributed-constant-line-type filter according to the present invention.

FIG. 6 shows still a further embodiment of a distributed-constant-line-type filter 50 according to the present invention.

The distributed-constant-line-type filter 50 includes distributed-constant-line-type resonators 51 and 52 similarly to the above-described filters. The resonators 51 and 52 are folded to reduce the mounting area in the same manner as the other above-described filters.

In order that the filter 50 functions as a band-pass filter, the resonators 51 and 52 must be magnetically coupled to each other. The magnetic coupling is established between a section 510 and a section 520. Therefore, the spacing between the sections 510 and 520 is at a distance at which desired magnetic coupling can be established.

However, magnetic coupling between the other sections is possible, for example, between the section 521 and the section 510, and between a section 511 and the section 520, and others. However, this coupling between the other sections might cause spurious signals in the filter. Therefore, for example, the section 511 should preferably be situated away from the section 520. However, if this is done, the mounting area of the filter increases. Therefore, an outer section 512 having a small contribution to the coupling between the resonators is brought close to the section 511. That is, the section having a large contribution to the coupling between the resonators, namely, the section having a larger current amplitude, is made as far away as possible from the more adjacent resonator, thereby preventing an occurrence of a spurious signal.

Figure 7:
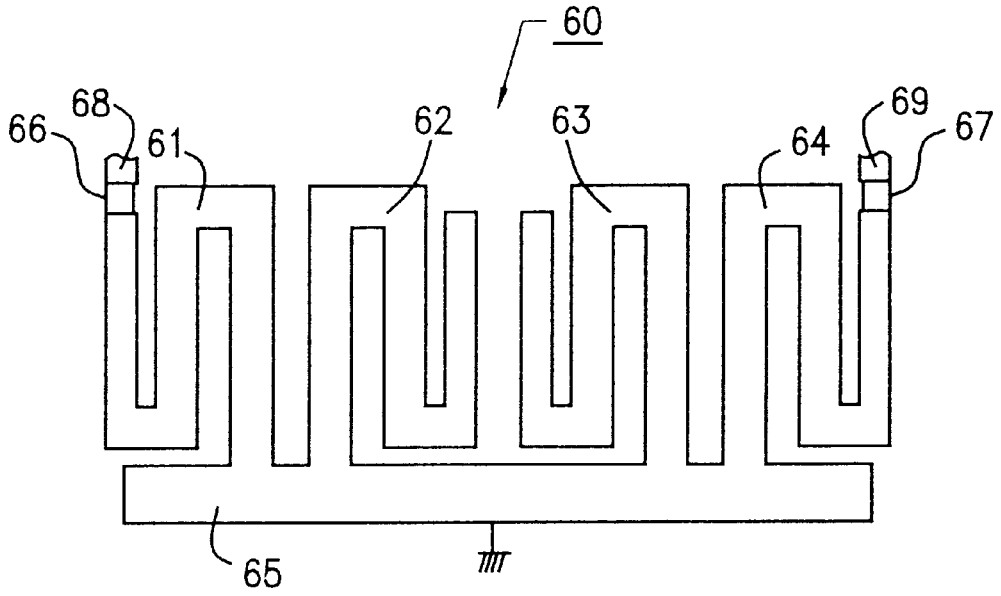
FIG. 7 shows the construction of still a further embodiment of a distributed-constant-line-type filter according to the present invention.

FIG. 7 shows still a further embodiment of a distributed-constant-line-type filter according to the present invention.

In FIG. 7, a distributed-constant-line -type filter 60 is a comb-line-type filter such that distributed-constant-line-type resonators 61, 62, 63, and 64 formed of a distributed-constant line whose length is approximately one fourth of a desired frequency, one end of which is open and the other end connected to a grounding electrode 65 and grounded, are each formed in a meandering shape and four of them are arrayed so as to be coupled to each other. A distributed-constant line 68 for input and a distributed-constant line 69 for output are connected to one end of each of the distributed-constant-line-type resonators 61 and 64 via comb-shaped coupling capacitors 66 and 67, respectively.

Figure 8:
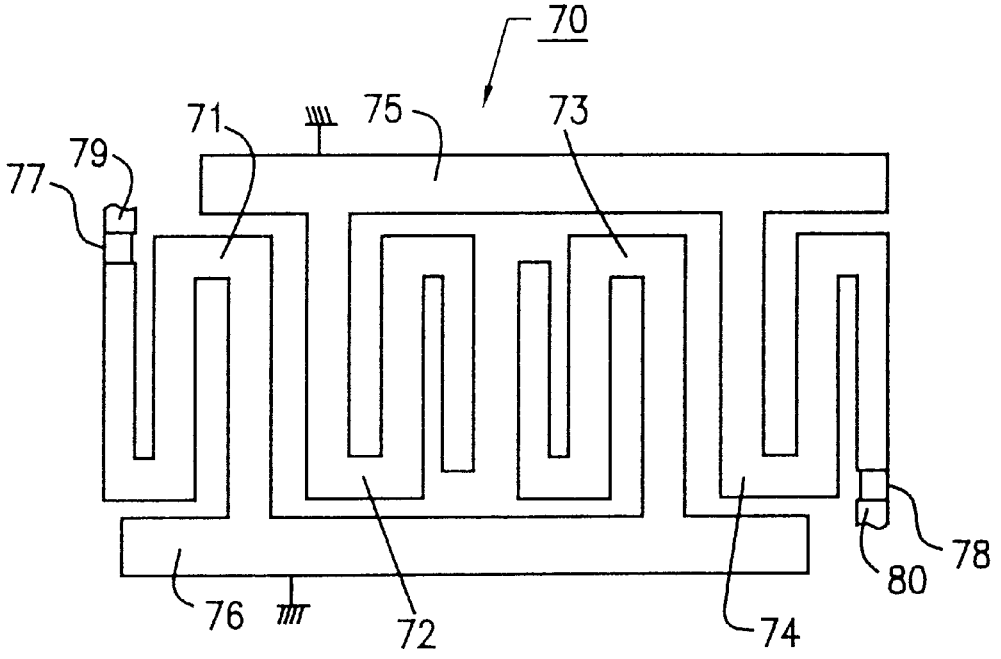
FIG. 8 shows the construction of still a further embodiment of a distributed-constant-line-type filter according to the present invention.
Figure 9:
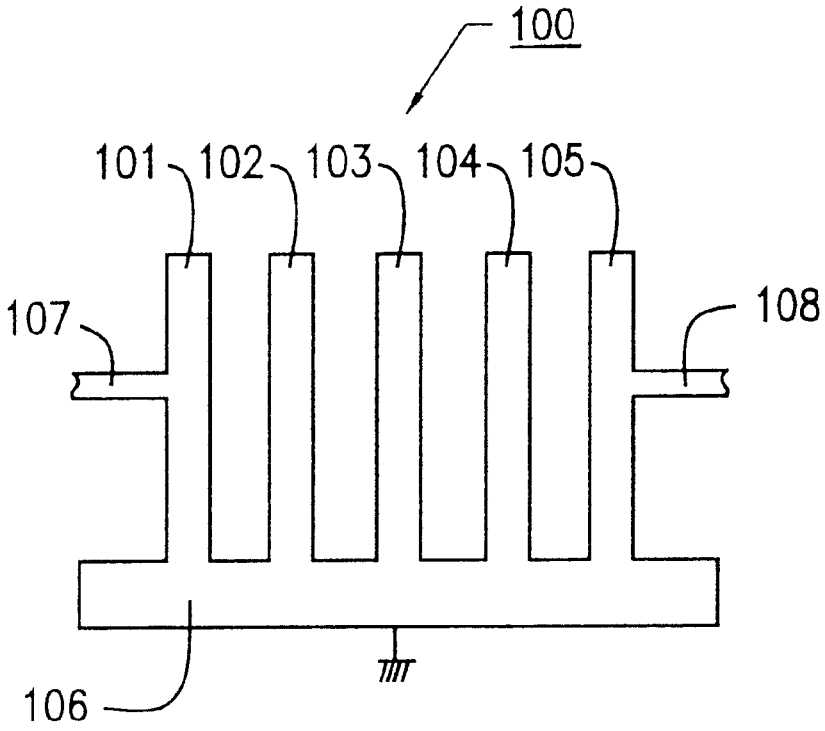
(PRIOR ART) FIG. 9
FIG. 9 shows the construction of a conventional distributed-constant-line-type filter.

FIG. 8 shows still a further embodiment of a distributed-constant-line-type filter according to the present invention. In FIG. 8, a distributed-constant-line-type filter 70 is an interdigital-type filter such that distributed-constant-line-type resonators 71, 72, 73, and 74 formed of a distributed-constant line whose length is approximately one fourth of a desired frequency, one end of which is open and the other end connected to grounding electrodes 75 and 76 and grounded, are each formed in a meandering shape and four of them are arrayed so as to be coupled to each other. A distributed-constant line 79 for input and a distributed-constant line 80 for output are connected to one end of each of the distributed-constant-line-type resonators 71 and 74 via comb-shaped coupling capacitors 77 and 78, respectively.

In FIGS. 7 and 8, the line width and the spacing between the adjacent sections are set in the same manner as in FIGS. 2, 4, and 6. By forming the distributed-constant-line-type resonator into multiple steps of three or more as described above, the attenuation level at both ends of the passing band of the distributed-constant-line-type filter can be increased.

In each of the above-described embodiments, the distributed-constant line for input may be used as a distributed-constant line for output, and the distributed-constant line for output may be used as a distributed-constant line for input.

Figure 11:
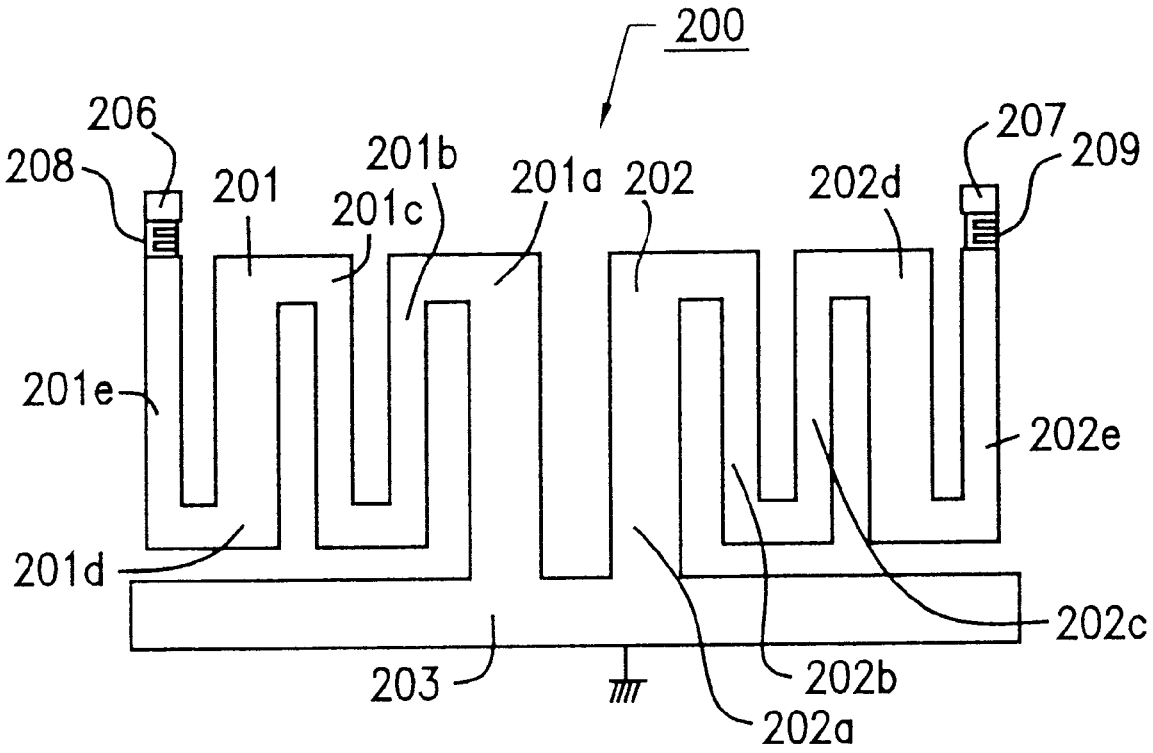
FIG. 11 shows the construction of an another embodiment of a distributed-constant-line-type filter according to the present invention.

Each of the above-described embodiments is a filter using a $\lambda/4$ resonator. However, the present invention can be applied to a filter using another type of resonator, for example, a $3\lambda/4$ resonator. In a distributed-constant-line-type filter 200 of FIG. 11, in $3\lambda/4$ resonators 201 and 202, sections where the amplitude of the electric current reaches a maximum are sections 201*a* and 201*d*. In the $3\lambda/4$ resonator, since it can be considered that waves of $3\lambda/4$ enter the resonator, there are two maximum points of the current amplitude within the resonator. That is, the current amplitude reaches a maximum near the sections 201*a* and 201*d*. Therefore, by widening the strip line widths of the sections 201*a* and 201*d* and narrowing the strip line widths of the other sections, for example, the sections 201*b* and 201*c*, it is possible to realize a reduction in the insertion loss of the filter while maintaining the filter at a small size.

The present disclosure relates to subject matter contained in Japanese Patent Application No. HEI 8-296365 filed on Nov. 8, 1996.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures and functions.

What is claimed is:

1. A filter device, comprising:

a signal input terminal;

a first distributed-constant-line-type resonator having a first end connected to said input terminal and a second end;

a second resonator laterally disposed with respect to the first distributed-constant-line-type resonator; and a signal output terminal connected to said second resonator, wherein the first distributed-constant-line-type resonator includes:

a first line portion coupled to the second resonator and extending transverse to the lateral direction;

a second line portion extending substantially parallel with and being spaced apart from the first line portion by a first distance; and a third line portion extending substantially parallel with and being spaced apart from the second line portion by a second distance which is smaller than the first distance.

2. A filter device according to claim 1, wherein the first end of said first distributed-constant-line-type resonator which is connected to said input terminal is an open end and the second end is grounded.

3. A filter device according to claim 2, wherein the width of said first distributed-constant-line-type resonator is greater near said grounded end than near said open end.

4. A filter device according to claim 2, wherein a distance from said open end to said grounded end is approximately one fourth of a wavelength of a signal having a resonance frequency of said first distributed-constant-line-type resonator.

5. A filter device according to claim 1, wherein a line width near a position where an amplitude of a standing wave at a resonance frequency of said first distributed-constant-line-type resonator reaches a maximum is greater than line widths at other positions.

6. A filter device according to claim 1, wherein said first distributed-constant-line-type resonator is formed of a strip line.

7. A filter device according to claim 1, further comprising a grounding conductor, wherein:

the second end of the first distributed-constant-line-type resonator is connected to said grounding conductor;

the second resonator is a second distributed-constant-line-type resonator, a first end of which is an open end and a second end of which is connected to said grounding conductor, said second distributed-constant-line-type resonator being electromagnetically coupled to said first distributed-constant-line-type resonator; and at least one of said resonators having a line width near a respective open end which is narrower than a line width near a respective grounded end.

8. A filter device according to claim 7, wherein either one of said first and second distributed-constant-line-type resonators includes folded line portions.

9. A filter device according to claim 8, wherein said folded line portions are tapered.

10. A filter device according to claim 7, wherein either one of said first and second distributed-constant-line-type resonators is shaped in a spiral.

11. A filter device according to claim 7, wherein said grounding conductor is divided into a section connected to said first distributed-constant-line-type resonator and a section connected to said second distributed-constant-line-type resonator, and said sections are independent of each other.

12. A filter device according to claim 11, wherein said independent grounding conductor sections are disposed in such a manner as to face each other, and said first and second resonators are disposed between said grounding conductor sections so as to be coupled to each other.

13. A filter device according to claim 1, wherein the first distributed-constant-line-type resonator includes a distributed constant line having a plurality of sections, each section having a width, at least two widths being different.

14. A filter device according to claim 7, wherein the first and second distributed-constant-line-type resonators include a distributed constant line having a plurality of sections, each section having a width, at least two widths being different.

* * * * *